US005914557A

United States Patent [19]

Tai et al.

[11] Patent Number: 5,914,557

[45] Date of Patent: Jun. 22, 1999

[54] COLOR CATHODE RAY TUBE

[75] Inventors: Nobuyuki Tai, Himeji, Japan; Shinji Ohama, Elmira, N.Y.; Shuuji Makimoto, Fukaya; Kouichi Soneda, Kumagaya, both of Japan

[73] Assignee: Kabushiki Kaisha Toshiba, Kawasaki, Japan

[21] Appl. No.: 09/081,206

[22] Filed: May 20, 1997

[30] Foreign Application Priority Data

May 20, 1997 [JP] Japan ..... 9-129732

[51] Int. Cl.[6] ..... H01J 29/80

[52] U.S. Cl. ..... 313/407; 313/404; 313/405

[58] Field of Search ..... 313/402, 404, 313/405, 406, 407

[56] References Cited

U.S. PATENT DOCUMENTS 5,576,595 11/1996 Inoue ..... 313/402

FOREIGN PATENT DOCUMENTS 46-8378 3/1971 Japan .

*Primary Examiner*—Vip Patel

*Attorney, Agent, or Firm*—Pillsbury, Madison & Sutro LLP

[57] ABSTRACT

A shadow mask opposed to a phosphor screen of a panel has a rectangular mask body and a rectangular mask frame fixed to the periphery of the mask body. The mask body has a pair of long side edges and a pair of short side edges, and the long side edges are respectively welded to long side walls of the mask frame while the short side edges are respectively welded to short side walls of the mask frame. The long and short side walls of the mask frame are respectively supported on the panel by mask holders. Each mask holder has a fixed portion welded to the mask frame and an engaging portion engaged with a stud pin of the panel. Welding positions between the long side edges of the mask body and the long side walls of the mask frame are shifted from the short axis, and welding positions between the short side edges of the mask body and the short side walls of the mask frame are shifted from the long axis.

9 Claims, 5 Drawing Sheets

COLOR CATHODE RAY TUBE

BACKGROUND OF THE INVENTION

The present invention relates to a color cathode ray tube.

In general, a color cathode ray tube comprises an envelope including a substantially rectangular panel provided with a skirt portion at the periphery of the panel, and a funnel. On the inner surface of the panel is formed a phosphor screen which includes a number of phosphor layers of three colors which radiate in red, blue,.and green. In the neck of the funnel is arranged an electron gun for emitting electron beams toward the phosphor screen. Inside the phosphor screen, a shadow mask is provided and opposed to the phosphor screen with a predetermined distance maintained therebetween.

In the color cathode ray tube, electron beams emitted from the electron gun are deflected by a deflector and subjected to selection by the shadow mask, so that the phosphor screen is scanned horizontally and vertically by the electron beams to display a color image.

The shadow mask has a substantially rectangular mask body having a surface opposed to the phosphor screen where a number of electron beam apertures are formed, and a rectangular mask frame welded to the periphery of the mask body. Plate-like frame holders are welded to the side walls of the mask frame. The shadow mask is supported on the inside of the panel by engaging the frame holders with stud pins fixed to the skirt portion of the panel.

In many of structures used for installing the mask body on the mask frame, the mask body is welded to the mask frame at each corner and at one or plural points in the area of the center of each side edge.

As a support structure for supporting the shadow mask on the panel, there has been a structure in which the shadow mask is supported by a band-like frame holder welded to the substantial center of each side wall. In this kind of shadow mask and the support structure thereof, the mask body and the mask frame are generally welded to each other, at positions which are slightly distant from engaging points of stud pins of the frame holder, avoiding welding points between the mask frame and the mask holder.

Meanwhile, 30% or less of the entire electron beams emitted from the electron gun enter into the phosphor screen, and the rest of the electron beams collide to the shadow mask. The kinetic energy of those electron beams is converted into thermal energy which heats the shadow mask and frame holder. If the shadow mask is thermally expanded by the heat, electron beam spots shaped by the shadow mask and formed on the phosphor screen are shifted from predetermined three-color phosphor layers, i.e., electron beams cause miss landing in relation to the phosphor layers. As a result, color purity is deteriorated.

This kind of miss landing of electron beams is roughly divided into two cases. In one case, miss lading is caused mainly by the mask body heated and thermally expanded, in an early stage of operation after the color cathode ray tube is started. In the other case, miss landing of electron beams is caused by the mask frame or the frame holder thermally expanded due to heat transferred from the mask body during operation of the color cathode ray tube for a long time (i.e., long-term purity drift).

In a certain cathode ray tube, a mask body made of invar (iron-nickel alloy) having a low thermal expansion coefficient is used in place of a mask body made of soft steel, in order to reduce the miss landing of electron beams caused by the thermal expansion of the shadow mask. In this case, the thermal expansion of the mask body itself can be reduced to be small.

However, when both the mask frame and the frame holders are thermally expanded during operation for a long time, there occurs a phenomenon that the mask body causes a localized displacement in asymmetric directions and landing of electron beams relative to the three-color phosphor layers is misregistered in asymmetric direction, e.g., in vertical, lateral, and rotational directions.

If a mask frame is not provided, a heated mask body is thermally expanded symmetrically in the radial direction and landing of electron beams is therefore not misregistered in asymmetric directions such as vertical, lateral, and rotational directions. Hence, misregistration in asymmetric directions such as vertical, lateral, and rotational directions is estimated to occur depending on the structure of installing the mask frame and the support structure of the shadow mask with respect to the mask body.

Taken into consideration a shadow mask having a mask body made of invar, a mask frame made of soft steel, and a frame holder made of stainless steel, the thermal expansion of the mask body is as small as 1/10 of that of the mask frame. Therefore, if the shadow mask is thermally expanded, the mask body is tensioned outwardly. However, the thermal expansion of the mask frame is absorbed by the skirt portion of the mask body, and does not substantially make effects on the effective portion of the mask body.

However, due to the thermal expansion of the mask frame, for example, welding points of the mask body on the short side edges thereof are shifted in the vertical direction (or Y-axis direction), and as a result, peripheral portions of the short side edges of the mask body are shifted in the vertical direction. Likewise, peripheral portions of the long edges of the mask body are shifted in the lateral direction (or X-axis direction) due to the thermal expansion of the mask frame. Because of these shifts in both the vertical and lateral directions, the peripheral portions of the mask body are shifted, as a whole, in the rotational direction.

Therefore, in the color cathode ray tube described above, landing of electron beams relative to the three-color phosphor layers is misregistered in asymmetrical directions such as the vertical, lateral, and rotational direction, so that white uniformity is deteriorated.

Among thermal expansions of the mask frame and mask holder, deterioration of the color purity caused by shifts of beam spots due to the thermal expansion of the mask frame can be reduced, to some extent, by adjusting electron beams in the inner circumferential direction of the screen, assuming a high luminance condition, in a stage of preparing factory preset or the like. However, as for deterioration of the color purity due to operation of the mask holder under a high luminance condition, electron beams cannot be adjusted in the rotational direction in the stage of preparing factory preset due to the structure of the color cathode ray tube, and therefore, deterioration of the color purity in the rotational direction cannot be reduced by any previous adjustment.

BRIEF SUMMARY OF THE INVENTION

The present invention has been made in view of problems described above and its object is to provide a color cathode ray tube which is improved in color purity by reducing miss landing of electron beams on a phosphor layer, caused by thermal expansion of a mask frame and frame holders.

To achieve the above object, a color cathode ray tube according to the present invention comprises: a panel including a substantially rectangular effective portion having an inner surface on which a phosphor screen is provided, and a substantially rectangular skirt portion provided along a side edge of the effective portion, the effective portion having a long axis and a short axis perpendicular to each other and passing through a tube axis, and the skirt portion having four side walls extending in parallel with the long axis and the short axis; a plurality of stud pins fixed to the skirt portion and positioned on the long axis and the short axis; a shadow mask having a substantially rectangular mask body opposed to the phosphor screen, and a substantially rectangular mask frame fixed to a peripheral portion of the mask body, the mask body having a long axis and an a short axis corresponding to the long axis and the short axis of the panel, and a pair of long side edges parallel to the long axis and a pair of short side edges parallel to the short axis, and the mask frame having a pair of long side walls respectively welded to the long side edges of the mask body and opposed substantially in parallel to each other, and a pair of short side walls respectively welded to the short side edges of the mask body and opposed substantially in parallel to each other; and a plurality of mask holders provided at least three of the long and short side walls of the mask frame and suspending the shadow mask on the panel, each of the mask holders extending in a lengthwise direction of a corresponding one of the side walls of the mask frame and having a fixed portion welded to the mask frame and an engaging portion engaged with a corresponding one of the stud pins.

Welding positions between the long side edges of the mask body and the long side walls of the mask frame are shifted from the short axis, and welding positions between the short side edges and the short side walls of the mask frame are shifted from the long axis.

Also according to the present invention, a relation of $LF/LH=(0.75 \text{ to } 1.00)\times\alpha H/\alpha F$ is satisfied where $\alpha F$ is a thermal expansion coefficient of the mask frame, $\alpha H$ is a thermal expansion coefficient of each of the mask holders, LF is a distance from the welding position between the mask frame and the mask holder to the welding position between the mask frame and the mask body in each of the long and short side walls of the mask frame, and LH is a distance from each of welding positions between the mask holders and the mask frame to a center axis of a corresponding one of the stud pin.

According to the color cathode ray tube constructed as described above, the welding positions between the long side edges of the mask body and the long side walls of the mask frame are shifted from the short axis, and the welding positions between the short side edges of the mask body and the short side walls of the mask frame are shifted from the long axis. By thus shifting the welding positions from the long axis or the short axis, the lengths in both sides of a welding position on each side wall of the mask frame are different from the lengths in both sides of a welding position on each edge of the mask body. As a result, the amount of deformation caused by the thermal expansion differs between each of the welding positions on the mask frame and each of the welding positions on the mask body.

Meanwhile, since the mask body has a smaller thermal expansion coefficient in comparison with the mask frame, the mask body is deformed so as to rotate or move in the diagonal direction, with respect to centers consisting of the welding positions with the mask frame, when the mask frame and the mask holder are thermal expanded. By arranging the direction of the movement to be the direction in which the movement of the mask frame is cancelled by operation of the mask holder, the mask body can substantially be maintained at a fixed position and landing misregistration can be reduced, so that color purity can be improved.

The welding position between the mask frame and each edge of the mask body is properly shifted to the side opposite to the welding position between the mask frame and a corresponding mask holder or is properly shifted to the side of the welding position between the mask frame and a corresponding mask holder, with respect to the long axis or the short axis. Therefore, a landing change peculiar to the case of supporting the shadow mask by mask holders attached on the side walls of the mask frame can be cancelled and a color cathode ray tube with improved color purity can be obtained.

Additional objects and advantages of the invention will be set forth in the description which follows, and in part will be obvious from the description,.or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIGS. 1 to 7 show a color cathode ray tube according to a first embodiment of the present invention, in which:

FIG. 1 is a cross-sectional view of the color cathode ray tube;

FIG. 2 is a perspective view of a shadow mask;

FIG. 3 is a side view showing a part of the shadow mask;

FIG. 4 is a cross-sectional view showing a state in which a panel of the color cathode ray tube and the shadow mask are installed;

FIG. 6 is a cross-sectional view showing the mask frame, the mask body, and mask holders in a state where the mask frame and mask holders are thermally expanded;

DETAILED DESCRIPTION OF THE INVENTION

In the following, color cathode ray tubes according to embodiments of the present invention will be explained in details.

Figure 1:
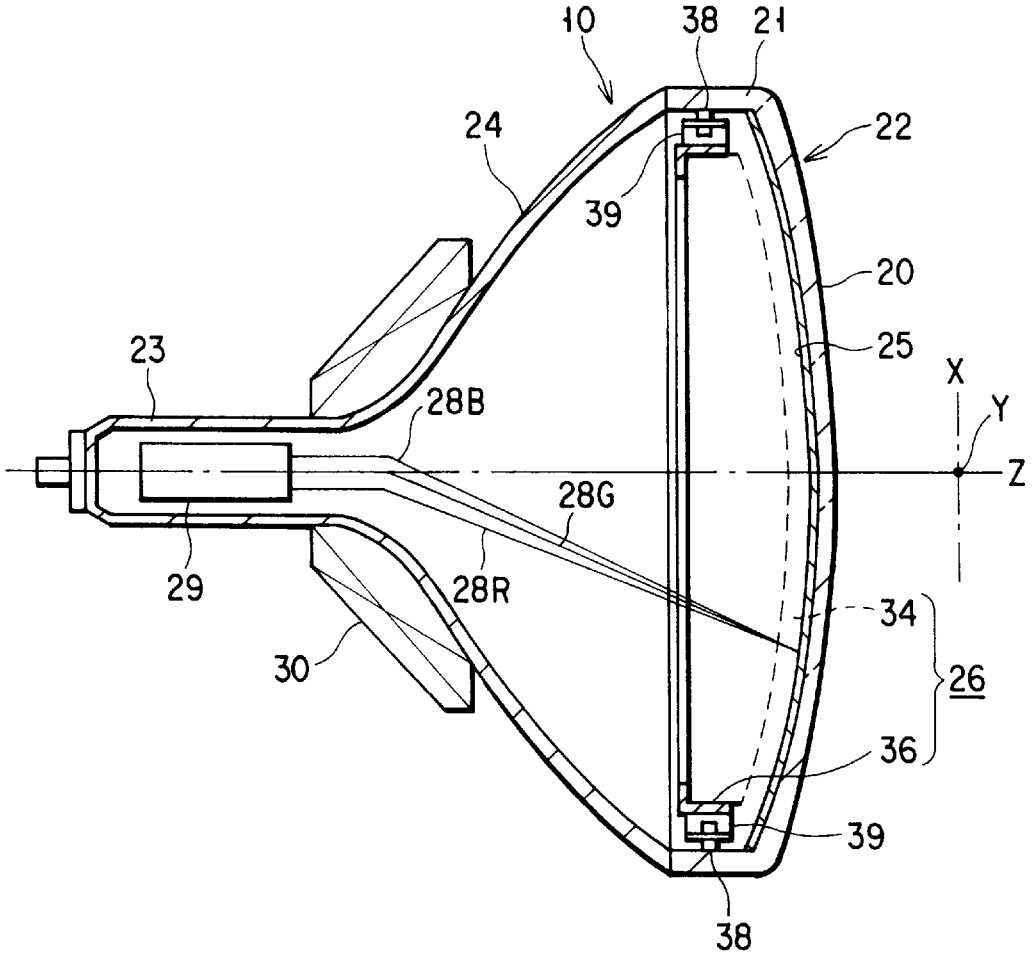
Figure 2:
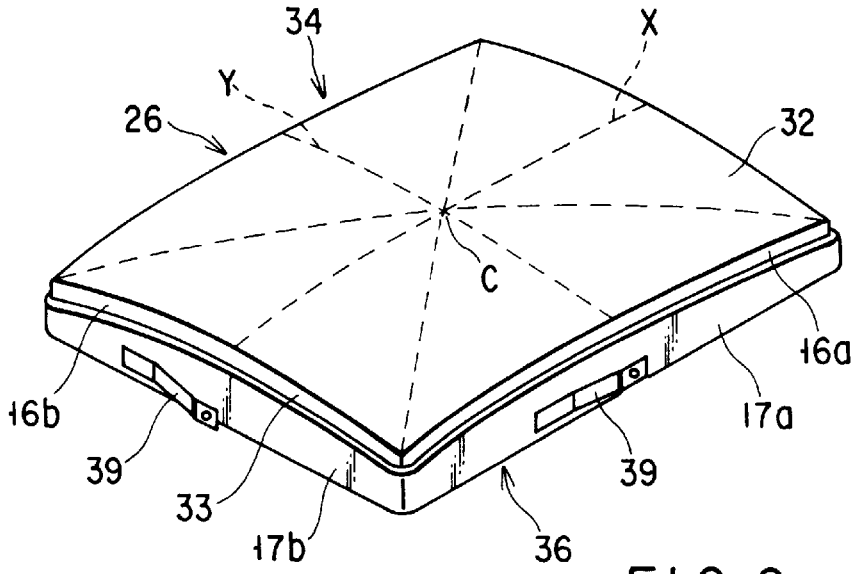

As shown in FIG. 1, a color cathode ray tube comprises a vacuum envelope 10. The vacuum envelope 10 includes a substantially rectangular panel 22 and a funnel 24. The panel 22 includes an effective portion 20 consisting of a curved surface, and a skirt portion 21 standing on the periphery of the effective portion. The funnel 24 has an end portion forming a cylindrical neck 23 and is joined to the skirt portion. On the inner surface of the panel 22 is formed a phosphor screen 25 consisting of a plurality of phosphor layers which respectively emit light in red, green, and blue, and light absorbing layers located between the phosphor layers. In the vacuum envelope 10, a shadow mask 26 is provided to oppose the phosphor screen 25, with a predetermined distance maintained from the phosphor screen.

An electron gun 29 which emits electron beams 28B, 28G, and 28R toward the phosphor screen 25 is provided in the neck 23 of the funnel 24. A deflection yoke 30 is mounted on the outer circumference of the funnel 24.

The color cathode ray tube displays a color image by deflecting the electron beams 28B, 28G, and 28R by means of a magnetic field generated from the deflector 30 to scan horizontally and vertically the phosphor screen 25 through the shadow mask 26.

As shown in FIGS. 1 to 4, the shadow mask 26 comprises a substantially rectangular mask body 34 and a rectangular mask frame 36 on which the mask body is equipped. The mask body 34 includes an effective surface 32 and a skirt portion 33 provided at the periphery of the effective surface 32. The effective surface 32 is formed of a curved surface opposing the phosphor screen 25 and is provided with a number of electron beam passage apertures. The mask frame 36 has a side wall 35 welded to the skirt portion 33 of the mask body 34 and is formed to have an L-shaped cross-section. The mask body 34 is formed of a material having a low thermal expansion coefficient, such as invar or the like, and the mask frame 36 is made of an iron material such as a cold-rolled steel plate.

The mask body 34 has a center C through which the tube axis Z of the color cathode ray tube passes, and a horizontal axis (long axis) X and a vertical axis (short axis) Y which pass through the center C and are perpendicular to each other. The skirt portion 33 has a pair of long side edges 16*a* parallel to the horizontal axis X and a pair of short side edges parallel to the vertical axis Y. The mask frame 36 is formed in a substantially rectangular shape having a pair of long side walls 17*a* parallel to the horizontal axis X and a pair of short side walls 17*b* parallel to the vertical axis Y.

The shadow mask 26 is supported on the panel 22 by an on-edge-four-pin method. Specifically, the panel 22 has a horizontal axis X and a vertical axis Y respectively corresponding to the horizontal and vertical axes of the shadow panel 22, and the skirt portion 21 has a pair of long side walls parallel to the horizontal axis and a pair of short side walls parallel to the horizontal axis. A stud pin 38 is fixed on an intermediate portion of each of the long and short side walls, and is positioned on the horizontal X or the vertical axis Y.

The mask holders 39 are respectively welded to the long side walls 17*a* and short side walls 17*b*, and the mask holders are engaged with corresponding stud pins 38, thereby supporting the shadow mask 26 on the panel 22. Each mask holder 39 is formed by bending an elongated rectangular plate and has a fixed portion 18a welded to the side wall of the mask frame 36, an engagement portion 18*b* engaged with the corresponding stud pin 38, and a slanting portion 18*c* extending and slanting between the fixed portion 18*a* and the engagement portion 18*b*. Each mask holder 39 extends along the side wall of the mask frame 36.

In the present embodiment, four frame holders 39 are provided such that the holders 39 are positioned to be rotation-symmetrical to each other with respect to the center C of the mask body 34. That is, the frame holders 39 are arranged such that each holder functions in one same rotational direction in response to its thermal expansion, e.g., the frame holders 39 are fixed to the mask frame in clockwise direction.

Figure 3:
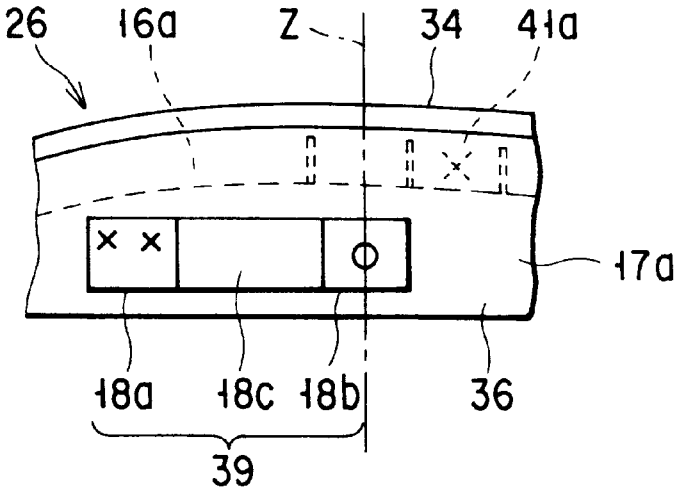
Figure 4:
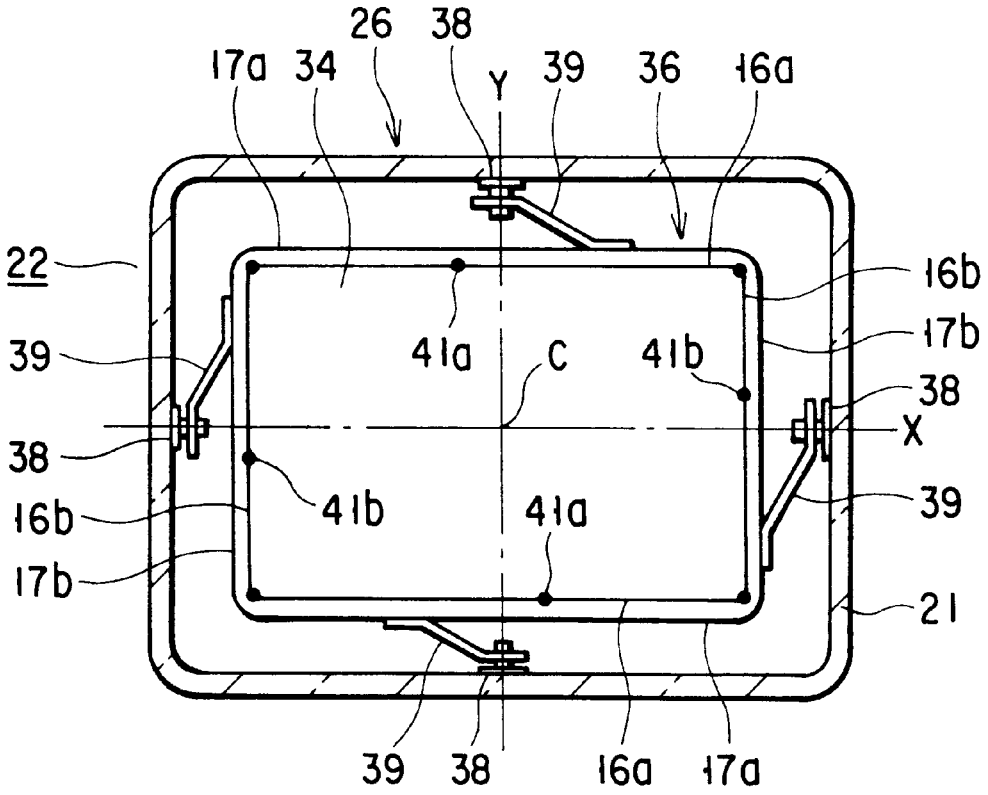
Figure 5A:
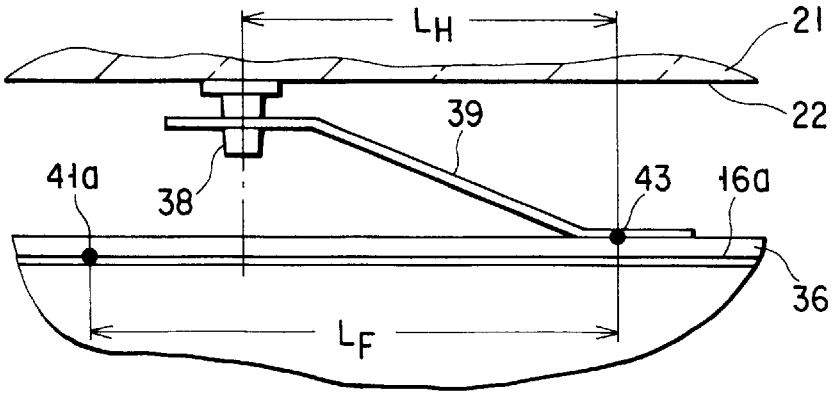
FIG. 5A is a view for explaining a relationship between welding positions of a mask frame of the shadow mask, a mask body thereof, and mask holders.
Figure 5B:
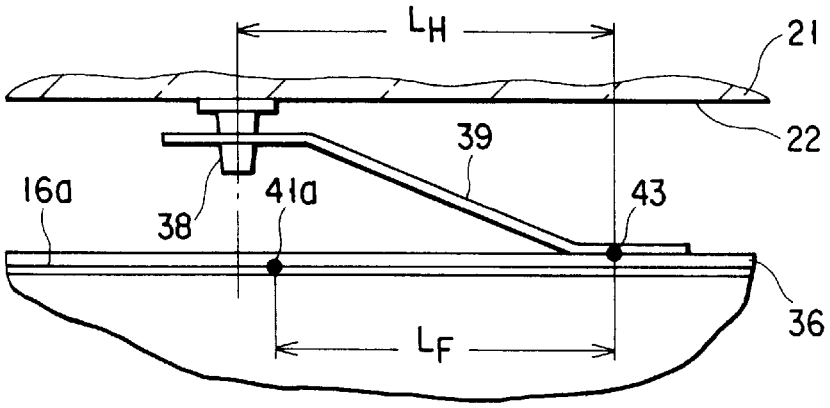
FIG. 5B is a view showing a relationship between the welding positions in a case wherein a mask frame and mask holders, which have different thermal expansion coefficients from those of the mask frame and mask holders in FIG. 5A.

As shown in FIGS. 3 and 4, the mask body 34 is connected to the mask frame 36 by respectively welding corner portions of the skirt portion 33 to corresponding corner portions of the mask frame, and by respectively welding the intermediate portions of the long side edge 16*a* and the short side edge 16*b* of the skirt portion 33 to corresponding long side walls 17*a* and short side walls 17*b*. The welding positions 41*a* between the long side edges 16*a* and the long side walls 17*a* are displaced from the vertical axis Y, and the welding positions 41*b* between the short side edges 16*b* and the short side walls 17*b* are displaced from the horizontal axis X.

The displacements of the welding positions 41*a* and 41*b* from the horizontal axis X and the vertical axis Y differ depending on materials of the mask frame 36 and the mask holder 39. Specifically, where the mask holder 39 has a larger thermal expansion coefficient than that of the mask frame 36, each of the welding positions 41*a* and 41*b* is displaced onto the side opposite to the welding position 43 where the mask holder 39 and the mask frame 36 are welded to each other, with respect to the vertical axis Y or horizontal axis X. On the contrary, where the mask holder 39 has a smaller thermal expansion coefficient than that of the mask frame 36, each of the welding positions 41*a* and 41*b* is displaced onto the side of the welding position 43, with respect to the vertical axis Y or horizontal axis X.

Welding positions 43 between the mask holders 39 and the mask frame 36 and the welding positions 41*a* and 41*b* between the mask frame 36 and the mask body 34 are set such that the thermal expansion amount of each mask holder 39 from the welding position 43 (welded to the mask frame 36) to the center of the stud pin 38 in the lengthwise direction becomes substantially equal to the thermal expansion amount of the mask frame 36 from the welding position 41*a* or 41*b* (welded to the mask body 34) to the welding position 42 in the same direction as the lengthwise direction, during operation of the cathode ray tube for a long time.

In other words, where the thermal expansion coefficient of the mask frame 36 is $\alpha F$, the thermal expansion coefficient of each mask holder 39 is $\alpha H$, the distance to each welding position 43 (between the mask frame 36 and the mask holder 39) from a corresponding welding position 41*a* or 41*b* (between the mask frame 36 and the mask body 34) is LF, and the distance from each welding position 43 to the center of a corresponding stud pin 38 is LH, each of the welding positions 41*a* and 41*b* between the mask frame 36 and the long and short side edges of the mask body 34 is set so as to satisfy the relation as follows.

$$LF/LH=(0.75\sim1.00)\times\alpha H/\alpha F$$

For example, where the mask frame 36 is made of an iron material and the mask holder 39 is made of a stainless-based spring material, the relation is as follows.

$$LF=(1.15 \text{ to } 1.45)\times LH$$

Where the mask frame 36 is made of an iron material and the mask holder 39 is made of a bimetal material, the relation is as follows.

$$LF=(0.90 \text{ to } 1.15)\times LH$$

According to the color cathode ray tube constructed as described above, it is possible to reduce miss landing of the electron beams which appears inherently when each of the mask body 34, the mask frame 36, and the mask holder 39 is heated and expanded during operation for a long time, i.e., landing shift including a rotation component in case where four holders 39 are attached rotation-symmetrically.

Figure 6:
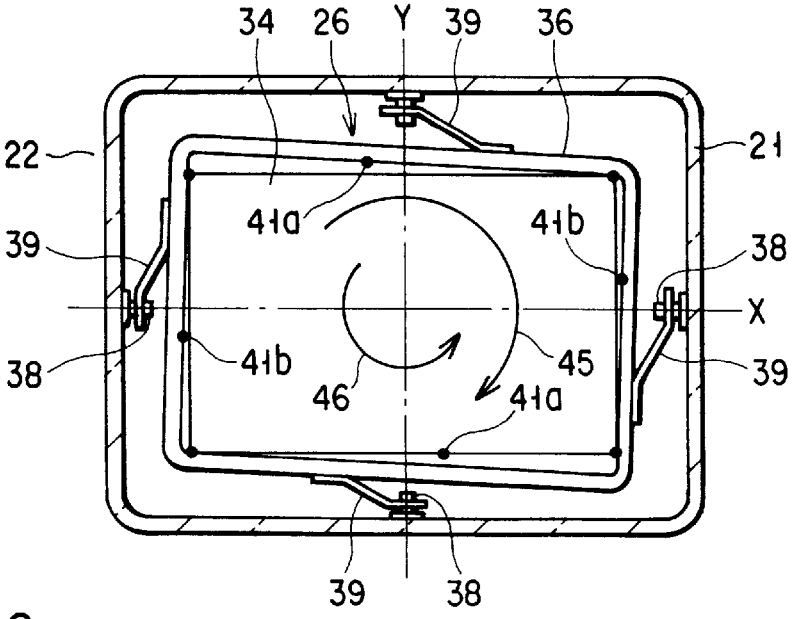

Specifically, if the mask holders 39 are attached to the long side walls 17*a* and short side walls 17*b* of the mask frame 36 as shown in FIG. 6, the mask holder 39 is thermally expanded in the lengthwise direction with respect to the stud pin 38 as a fixed point thereby rotating the mask frame 36 in the direction of an arrow 45, as the mask body 34, the mask frame 36, and the holders 39 are heated. This is caused by the following two reasons.

Figure 7A:
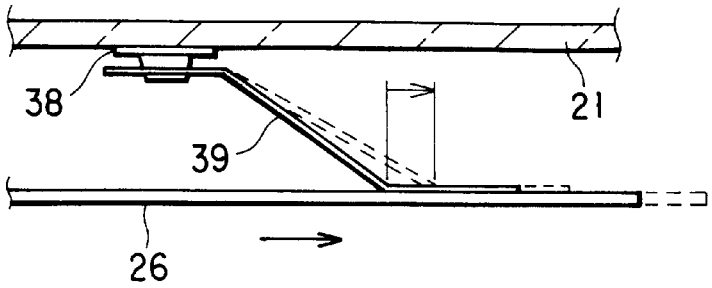
FIG. 7A is a side view showing in which the mask frame and the mask holders are thermally expanded in lengthwise directions, respectively.
Figure 7B:
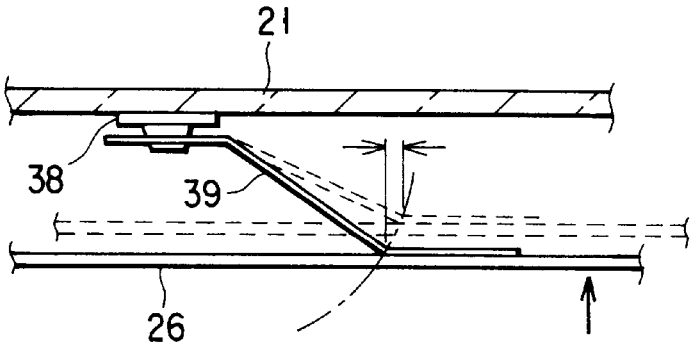
FIG. 7B is a plan view showing a state in which the mask holders are pressed by a thermal expansion of the mask frame.

The first reason is a thermal expansion difference between the mask holder 39 and the mask frame 36, as shown in FIG. 7A. A power component parallel to each side wall portion of the mask frame is caused due to a movement amount by which each side wall portion of the mask frame 36 is moved in the horizontal or vertical axis direction and due to a movement of each fixed point which is moved in the horizontal or vertical axis direction by a change in length due to a thermal expansion. Secondly, as shown in FIG. 7B, the mask frame 36 is moved in the radial direction due to a thermal expansion to push each mask holder 39 toward the skirt portion 21 of the panel 22, and as a result, each mask holder is deformed in the direction in which each mask holder extends. In this manner, a force component is generated in the direction parallel to each of the side walls of the mask frame 36.

By the two force components, a rotation component of the mask frame 36 is generated and the shadow mask 26 is rotated around the center C. Note that broken lines in FIGS. 7A and 7B indicated conditions after a thermal expansion, respectively.

As shown in FIG. 6, the entire mask frame 36 is thermally expanded so that the welding positions 41*a* and 41*b* between the mask body 34 and the mask frame 36 are going to move in the directions in which these positions are apart from the horizontal axis X and the vertical axis Y of the shadow mask 26, respectively. Viewed from the mask body 34, the movements of the welding positions 41*a* and 41*b* between the mask body 34 made of a low thermal expansion material and the mask frame 36 are smaller than the mask frame 36. Therefore, the mask body 34 receives a force which acts to rotate the mask body 34 in the direction of the arrow 46 due to a difference in thermal expansion.

In this case, the welding between the mask body 34 and the mask frame 36 at corner portions acts to resist the force as described above. However, the force which rotates the mask body 34 in the direction of the arrow 46 has a larger absolute value than the resistance by the welding. As a result, the mask body 34 rotates and shifts in a direction opposite to the direction of the arrow 45 of the rotation shift caused by the thermal expansion of the mask holder 39.

The amount of the rotation shift of the mask body 34 in the mask frame 36 increases as the welding positions 41*a* and 41*b* moves apart from the horizontal axis X and the vertical axis Y. Therefore, it is possible to eliminate the rotation of the mask body 34 so that the shadow mask 26 does not look to be moved in relation to the panel 22, by setting the welding positions 41*a* and 41*b* between the mask body and the mask frame 36 having a larger thermal expansion coefficient than the mask body 34, as well as the welding positions between the mask frame 36 and the mask holder 39, as described above.

Figure 8:
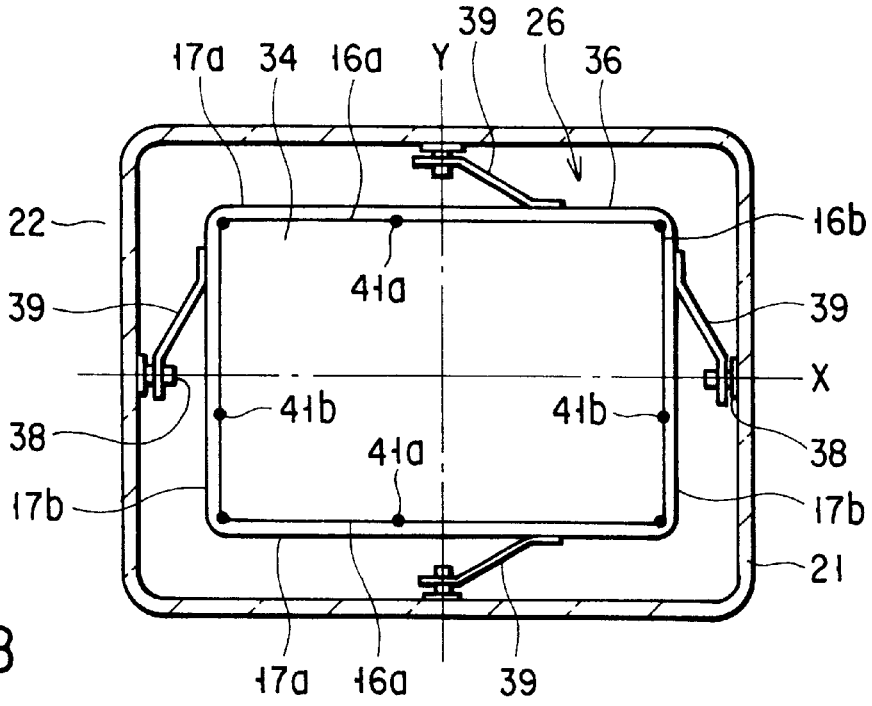
FIG. 8 is a cross-sectional view showing a layout of a shadow mask and mask holders in a color cathode ray tube according to a second embodiment of the present invention.

Although the above embodiment has been explained with reference to a structure in which four mask holders 39 are attached to the mask frame 36, the mask holders 39 may be attached to be mirror-symmetrical with respect to the horizontal axis X and the vertical axis Y of the shadow mask 26, as shown in FIG. 8.

In this structure, the relationship between the welding positions 41*a* and 41*b* between the mask frame 36 and the mask body 34 and the welding positions 43 between the mask frame 36 and the mask holder 39 are set so as to satisfy the following relation, like in the embodiment described above.

$$LF/LH=(0.75 \text{ to } 1.00)\times\alpha H/\alpha F$$

The other structure is the same as in the embodiment described above. The same components as those of the embodiment described above are referred to by the same reference symbols and detailed explanation thereof will be omitted.

Figure 9:
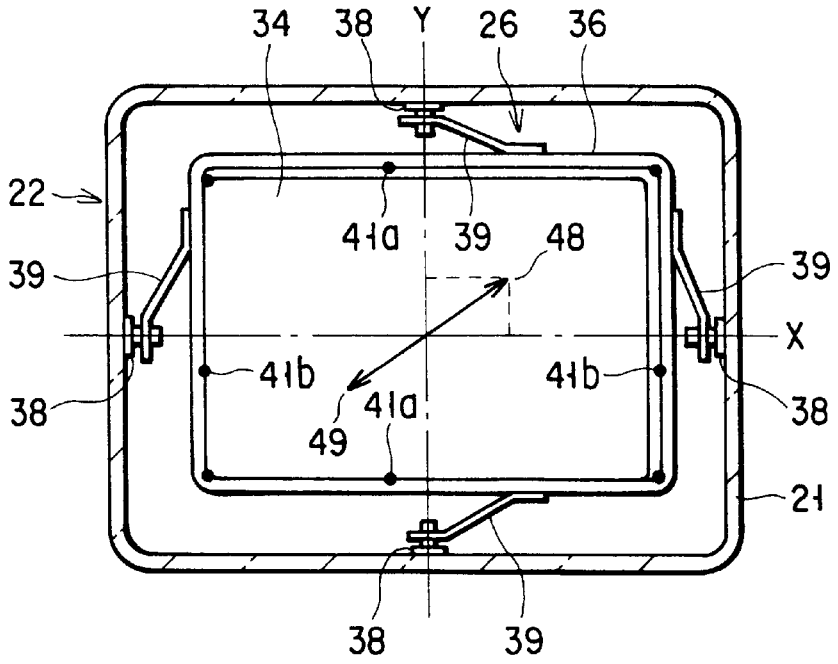
FIG. 9 is a cross-sectional view showing a state of a mask frame, a mask body, and the mask holders when the mask frame and the mask holders are thermally expanded in the second embodiment.

In the color cathode ray tube in which four mask holders 39 are arranged to be mirror-symmetrical, when the mask body 34, the mask frame 36, and the holders 39 are heated as described above, each of the mask holders 39 is thermally expanded in the lengthwise direction from the stud pin 38 as a fixing point thereby shifting the mask frame 36 and the mask body 34 in the diagonal direction indicated by the arrow 48, as showing FIG. 9. Therefore, a landing change having horizontal and vertical components appears.

However, according to the present embodiment, the mask body 34 is shifted, inside the mask frame, in the direction of the arrow 49 opposite to the diagonal direction of the shift of the mask holder 39 caused by a thermal expansion, by setting the welding positions 41*a* and 41*b* of the mask frame 36 to the side edges of the mask body 34, as well as the welding positions 43 between the mask frame 36 and the mask holder 39, as described above. Thus, the shift of the mask body 34 in the diagonal direction can be cancelled, so that the shadow mask 26 looks to be not moved in relation to the panel 22. Accordingly, a landing change or miss landing of the electron beams, containing horizontal and vertical components can be reduced and deterioration of color purity can be prevented, even when four mask holders 39 are arranged to be mirror-symmetrical with respect to the horizontal axis X and the vertical axis Y of the shadow mask 26.

As described above, according to the color cathode ray tube constructed as described above, landing change or landing misregistration of electron beams caused by thermal expansions of the shadow mask can be reduced and an image with excellent color purity can be obtained, both in the cases wherein the four mask holders 39 are arranged rotation-symmetrical and mirror-symmetrical.

EXAMPLE 1

Explanation will be made of a case where four mask holders 39 are fixed to be rotation-symmetrical with respect to the center C of the mask body 34, on the long side walls 17*a* and short side walls 17*b* of the mask frame 36, as shown in FIG. 4.

It is supposed that the mask body 34 is made of an invar material having a thermal expansion coefficient $\alpha M=0.1\times 10^{-5}$ or so, the mask frame 36 is made of an iron material having a thermal expansion coefficient $\alpha F=1.2\times10^{-5}$ or so, the mask holders 39 are each made of a stainless-steel-based spring material having a thermal expansion coefficient $\alpha H=1.7\times10^{-5}$, and the length (or distance LH) from each welding position 43 of the mask holders 39 with the mask frame 36 to the center axis of a corresponding stud pin 38 is 40 mm. The welding positions between the mask frame 36 and respective side edges of the mask body 34 are set at positions shifted by 10 mm to the side opposite to the welding positions 43 between the mask holders 39 and the mask frame 36 with respect to the horizontal axis X and the vertical axis Y.

In general, the temperature tF of the mask frame 36 during operation of the cathode ray tube for a long time is 30 to 50° C., and the temperature tH of the mask holders is about 75 to 100% of the temperature. Where the temperature of the mask frame 36 of the color cathode ray tube during operation for a long time is 40° C. and the temperature of the mask holders 39 is 35° C., the thermal expansion amount ΔH of the mask holders 39 is as follows.

$$\Delta H=40\text{ mm}\times35^\circ\text{ C.}\times1.7\times10^{-5}=23.8\ \mu\text{m}$$

Meanwhile, that portion of the mask frame 36 which located between each of the welding positions 43 to the horizontal axis X or the vertical axis Y has a thermal expansion amount ΔF as follows.

$$\Delta F=40\text{ mm}\times40^\circ\text{ C.}\times1.2\times10^{-5}=19.2\ \mu\text{m}$$

In this case, the positions of the mask frame 36 on the horizontal axis X and the vertical axis Y are considered as being moved in the direction of the arrow 45 by ΔH−ΔF= 23.8 μm−19.2 μm=4.6 μm, as shown in FIG. 6.

That is, if the welding positions between the mask frame 36 and the side edges of the mask body 34 are set on the horizontal axis X and the vertical axis Y, the mask body 34 is considered to be rotated by 4.6 μm in accordance with the rotation of the mask frame.

However, if the welding positions 41*a* and 41*b* are respectively shifted by 10 mm to the sides opposite to the welding positions 43 between the mask frame 36 and the mask holders 39, with respect to the horizontal axis X and the vertical axis Y of the shadow mask 26, and the distance LF from the welding positions 43 to the welding positions 41*a* and 41*b* is set to 50 mm, as in this example 1, that portion of the mask frame which is located between the horizontal or vertical axis to the corresponding one of the welding positions 41*a* and 41*b* of the mask frame 36 is thermally expanded by 10 mm×40° C.×$1.2\times10^{-5}$=4.8 μm.

In this case, the mask body 34 made of an invar material having a small thermal expansion coefficient of 1/10 of that of the mask frame 36 is rotated by 4.8 μm in the direction opposite to the rotation direction of the mask frame 36 in accordance with the movement of the welding positions 41*a* and 41*b* between the mask frame 36 and the mask body 34, so that the rotation shift of the mask frame 36 is cancelled. As a result, it is possible to reduce a landing change caused by the mask body 34, the mask frame 36, and the mask holders 39 heated and thermally expanded during operation of the color cathode ray tube for a long time, so that deterioration of color purity is prevented.

In this case, the relationship between the mask body 34, the mask frame 36, and the holders 39 is generalized as follows.

$$LF\times tF\times\alpha F=LH\times tH\times tH\times\alpha H=LH\times(0.75\text{ to }1.00)tH\times\alpha H$$

Hence, the following is obtained.

$$LF/LH=(0.75\text{ to }1.00)\alpha H/\alpha F$$

Where the mask frame 36 is made of an iron material ($\alpha F=1.2\times10^{-5}$ or so) and the mask holder 39 is made of a stainless-based spring-material ($\alpha H=1.7\times10^{-5}$ or so), the following is obtained from the above equation.

$$LF=(1.15\text{ to }1.45)LH$$

EXAMPLE 2

Explained next will be the case where the four mask holders 39 are attached to be mirror-symmetrical with respect to the horizontal axis X and the vertical axis Y of the shadow mask 26, on the long and short side walls of the mask frame 36, as shown in FIG. 8.

Like the example 1, it is supposed that the mask body 34 is made of an invar material, the mask frame 36 is made of an iron material, the mask holders 39 are each made of a stainless-steel-based spring material, and the distance LH from each welding position 43 of the mask holders 39 with the mask frame 36 to the center axis of a corresponding stud pin 38 is 40 mm. The welding positions 41*a* and 41*b* between the mask frame 36 and the edges of the mask body 34 are respectively set at positions shifted by 10 mm to the sides opposite to the welding positions 43 between the mask holders 39 and the mask frame 36 with respect to the horizontal axis X and the vertical axis Y.

Where the temperature of the mask frame 36 of the color cathode ray tube during operation for a long time is 40° C. and the temperature of the mask holders 39 is 35° C., the thermal expansion amount ΔH of the mask holders 39 is as follows.

$$\Delta H=40\text{ mm}\times35^\circ\text{ C.}\times1.7\times10^{-5}=23.8\ \mu\text{m}$$

Meanwhile, the portion of the mask frame 36, extending from each of the welding positions 43 to the horizontal axis X or the vertical axis Y has a thermal expansion amount ΔF as follows.

$$\Delta F=40\text{ mm}\times40^\circ\text{ C.}\times1.2\times10^{-5}=19.2\ \mu\text{m}$$

The position of the mask frame 36 on the horizontal axis and the vertical axis is shifted by the following amount in the direction parallel to the diagonal direction indicated by the arrow 48.

$$\Delta H-\Delta F=23.8\ \mu\text{m}-19.2\ \mu\text{m}=4.6\ \mu\text{m}$$

In this case, if the welding positions 41*a* and 41*b* of the mask frame 36 with the edges of the mask body 34 are shifted by 10 mm to the sides opposite to the welding positions 43 with respect to the horizontal axis X and the vertical axis Y, the portion from the horizontal or vertical axis to corresponding one of the welding positions 41*a* and 41*b* of the mask frame 36 is thermally expanded by 10 mm×40° C.×$1.2\times10^{-5}$=4.8 μm, and the welding positions 41*a* and 41*b* are respectively shifted in the direction of the arrow 49 which is opposite and parallel to the direction of the arrow 49.

Therefore, also in this case, the mask body 34 made of an invar material having a small thermal expansion coefficient of about 1/10 of that of the mask frame 36 is shifted in accordance with the movement of the welding positions 41*a* and 41*b* between the mask frame 36 and the mask body 34, thus reducing a landing change caused by the thermal expansion of the mask body 34, the mask frame 36, and the mask holders 39 during operation of the color cathode ray tube for a long time, so that deterioration of color purity is prevented.

In this case, the relationship between the mask body 34, the mask frame 36, and the holders 39 is generalized as follows, like the example 1.

$$LF/LH=(0.75 \text{ to } 1.00)\alpha H/\alpha F$$

Where the mask frame 36 is made of an iron material ($\alpha F=1.2\times10^{-5}$ or so) and the mask holder 39 is made of a stainless-based spring material ($\alpha H=1.7\times10^{-5}$ or so), the following is obtained from the above equation.

$$LF=(1.15 \text{ to } 1.45)LH$$

EXAMPLE 3

Explained next will be the case where the four mask holders 39 are arranged to be rotation-symmetrical with respect to the center C of the mask body 34, on the long and short side walls of the mask frame 36, as shown in FIG. 4.

It is supposed that the mask body 34 is made of an invar material having a thermal expansion coefficient $\alpha M=0.1\times10^{-5}$ or so, the mask frame 36 is made of an iron material having a thermal expansion coefficient of $\alpha F=1.2\times10^{-5}$ or so, the mask holders 39 are each made of a bimetal material having a thermal expansion coefficient $\alpha H=1.3\times10^{-5}$, and the distance LH from each welding position 43 of the mask holders 39 with the mask frame 36 to the center axis of a corresponding stud pin 38 is 40 mm. The welding positions 41*a* and 41*b* between the mask frame 36 and the edges of the mask body 34 are respectively set at positions shifted by 2 mm to the sides of the welding positions 43 between the mask holders 39 and the mask frame 36, with respect to the horizontal axis X and the vertical axis Y.

Where the temperature of the mask frame 36 of the color cathode ray tube during operation for a long time is 40° C. and the temperature of the mask holders 39 is 35° C., the thermal expansion amount ΔH of the mask holders 39 is as follows.

$$\Delta H=40 \text{ mm}\times35^\circ \text{ C.}\times1.3\times10^{-5}=18.2\ \mu\text{m}$$

Meanwhile, the portion of the mask frame 36 from each of the welding positions 43 to the horizontal axis X or the vertical axis Y has a thermal expansion amount ΔF as follows.

$$\Delta F=40 \text{ mm}\times40^\circ \text{ C.}\times1.2\times10^{-5}=19.2\ \mu\text{m}$$

In this case, the position of the mask frame 36 on the horizontal axis X and the vertical axis Y is rotated and shifted by the following amount.

$$\Delta H-\Delta F=18.2\ \mu\text{m}-19.2\ \mu\text{m}=-1.0\ \mu\text{m}$$

In this case, if the welding positions 41*a* and 41*b* of the mask frame 36 with the edges of the mask body 34 are shifted by 2 mm to the sides of the welding positions 43 with respect to the horizontal axis X and the vertical axis Y, the portion from the horizontal or vertical axis to each of the welding positions 41*a* and 41*b* of the mask frame 36 is thermally expanded by the following amount.

$$2 \text{ mm}\times40^\circ \text{ C.}\times1.2\times10^{-5}=0.96\ \mu\text{m}$$

As a result, the welding positions 41*a* and 41*b* between the mask frame 36 and the mask body 34 are respectively rotated in the direction opposite to the rotation direction of the mask frame, thereby canceling the rotation shift of the mask frame 36. Therefore, a landing change caused by the thermal expansion of the mask body 34, the mask frame 36, and the mask holders 39 is reduced during operation of the color cathode ray tube for a long time, and deterioration of color purity is prevented.

In this case, the relationship between the mask body 34, the mask frame 36, and the holders 39 is generalized as follows, like the example 1.

$$LF/LH=(0.75 \text{ to } 1.00)[[g]aH/\alpha F$$

Where the mask frame 36 is made of an iron material ($\alpha F=1.2\times10^{-5}$ or so) and each of the mask holders 39 is made of a bimetal spring material ($\alpha H=1.3\times10^{-5}$ or so), the following is obtained from the above equation.

$$LF=(0.9 \text{ to } 1.00)LH$$

The embodiment described above does not specifically limit the number of welding points between the mask frame and each mask holder. In case where the mask frame and each mask holder are welded at a plurality of points positioned apart from each other in the lengthwise direction of the mask holder, a desired effect can be obtained by satisfying the relations described above, with the middle point of the plurality of points regarded as the welding position.

In addition, the present invention is not limited to the embodiment described above, but can be variously modified within the scope of the present invention. For example, the number of mask holders is not limited to four but may be three as shown in FIG. 10.

Figure 10:
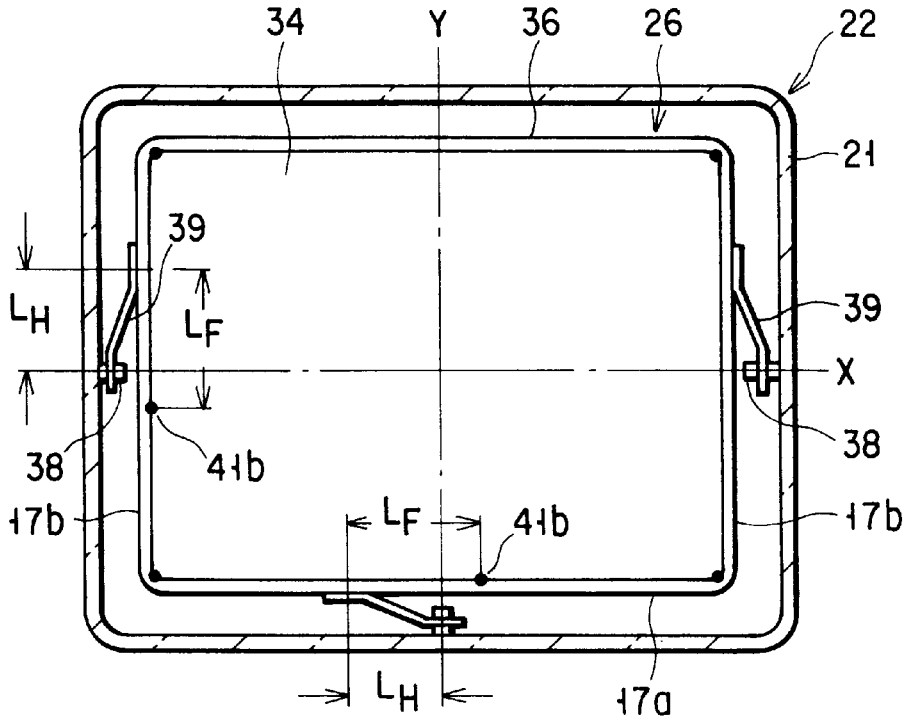
FIG. 10 is a cross-sectional view showing a layout of a shadow mask and mask holders in a color cathode ray tube according to a third embodiment of the present invention.

According to the embodiment shown in FIG. 10, three mask holders 39 are respectively welded and fixed to a pair of short side walls 17*b* and a long side wall of the mask frame 36. The other structure is the same as in the embodiment described above. The same components as those of the embodiment describe above are denoted by the same reference symbols, and detailed explanation thereof will be omitted.

In the present embodiment, also, it is possible to reduce miss landing of electron beams and to obtain a color cathode ray tube with improved color purity and white uniformity, by setting the relationship between the welding positions 41*a* and 41*b* between the mask holders and the mask frame, the welding positions 41*a* and 41*b* between the edges of the mask body 34 and the mask frame 36, and the stud pins 38, in the same manner as in the embodiment described above, i.e., by setting the relationship so as to satisfy the relation of $LF/LH=(0.75 \text{ to } 1.00)\times\alpha H/\alpha F$.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A color cathode ray tube comprising:

a panel including a substantially rectangular effective portion having an inner surface on which a phosphor screen is formed, and a substantially rectangular skirt portion provided along a side edge of the effective portion, the effective portion having a long axis and a short axis perpendicular to each other and passing through a tube axis, and the skirt portion having four side walls extending in parallel with the long axis and the short axis;

a plurality of stud pins fixed to the skirt portion and positioned on the long axis and the short axis, respectively;

a shadow mask having a substantially rectangular mask body opposed to the phosphor screen, and a substantially rectangular mask frame fixed to a peripheral portion of the mask body, the mask body having a long axis and a short axis corresponding to the long axis and the short axis of the panel, respectively, and a pair of long side edges parallel to the long axis and a pair of short side edges parallel to the short axis, and the mask frame having a pair,of long side walls respectively welded to the long side edges of the mask body and opposed substantially in parallel to each other, and a pair of short, side walls respectively welded to the short side edges of the mask body and opposed substantially in parallel to each other; and a plurality of mask holders provided at least three of the long and short side walls of the mask frame and suspending the shadow mask on the panel, each of the mask holders extending in a lengthwise direction of a corresponding one of the side walls and having a fixed portion welded to the mask frame and an engaging portion engaged with a corresponding one of the stud pins, wherein welding positions between the long side edges of the mask body and the long side walls of the mask frame are shifted from the short axis, and welding positions between the short side edges and the short side walls of the mask frame are shifted from the long axis.

2. A color cathode ray tube according to claim 1, wherein welding positions between the frame holders and the mask frame and the welding positions between the mask frame and the mask body are set such that a thermal expansion amount of each of the mask holders along a lengthwise direction from the welding positions of the frame holders to a center of a corresponding one of the stud pins is substantially equal to a thermal expansion amount of that portion of the mask frame along the lengthwise direction which is located between each of the welding positions of the frame holders and a corresponding one of the welding positions between the mask frame and the mask body.

3. A color cathode ray tube according to claim 1, wherein a relation of $$LF/LH=(0.75 \text{ to } 1.00)\times\alpha H/\alpha F$$

is satisfied where $\alpha F$ is a thermal expansion coefficient of the mask frame, $\alpha H$ is a thermal expansion coefficient of each of the mask holders, LF is a distance between the welding position to the mask holder and the welding position to the mask body, in each of the long and short side walls of the mask frame, and LH is a distance from each of welding positions between the mask holders and the mask frame to a center axis of a corresponding one of the stud pin.

4. A color cathode ray tube according to claim 3, wherein the mask frame is made of an iron material, each of the mask holders is made of a stainless-based spring material, and a relation of LF=(1.15 to 1.45)×LH is maintained.

5. A color cathode ray tube according to claim 3, wherein the mask frame is made of an iron material, each of the mask holders is made of a bimetal material, and a relation of LF=(1.15 to 1.45)×LH is maintained.

6. A color cathode ray tube according to claim 1, wherein each of the mask holders has a larger thermal expansion coefficient than that of the mask frame, and each of the welding positions between the long side edges of the mask body and the long side walls of the mask frame is shifted onto a side opposite to a welding position between a corresponding one of the mask holders and the mask frame, with respect to the short axis, while each of the welding positions between the short side edges of the mask body and the short side walls of the mask frame is shifted onto a side opposite to a welding position between a corresponding one of the mask holders and the mask frame, with respect to the long axis.

7. A color cathode ray tube according to claim 1, wherein each of the mask holders has a smaller thermal expansion coefficient than that of the mask frame, and each of the welding positions between the long side edges of the mask body and the long side walls of the mask frame is shifted onto a side of a welding position between a corresponding one of the mask holders and the mask frame, with respect to the short axis, while each of the welding positions between the short side edges of the mask body and the short side walls of the mask frame is shifted onto a side of a welding position between a corresponding one of the mask holders and the mask frame, with respect to the long axis.

8. A color cathode ray tube according to claim 1, wherein the plurality of mask holders are respectively provided on the pair of long side walls and the pair of short side walls of the mask frame and are arranged to be rotation-symmetrical around the tube axis as a center.

9. A color cathode ray tube according to claim 1, wherein the plurality of mask holders are respectively provided on the pair of long side walls and the pair of short side walls of the mask frame, and a pair of the mask holders provided on the short side walls are arranged to be symmetrical with respect to the short axis while a pair of the mask holders provided on the long side walls are arranged to be symmetrical with respect to the long axis.

* * * * *